United States Patent [19]

Ernst et al.

[11] Patent Number: 4,729,422

[45] Date of Patent: Mar. 8, 1988

[54] PROCESS AND APPARATUS FOR THE PRODUCTION OF HOLLOW BODIES BY CONTINUOUSLY CASTING IN A MAGNETIC FIELD

[75] Inventors: Roland Ernst, Gieres; Marcel Garnier, Grenoble; Michel Giroutru, Saint-Egreve; André Gueussier, Paris; René Moreau, Voiron; Pierre Peytavin, Neuilly-sur-Seine, all of France

[73] Assignee: Vallourec, Paris, France

[21] Appl. No.: 797,773

[22] Filed: Nov. 8, 1985

Related U.S. Application Data

[63] Continuation of Ser. No. 457,426, Jan. 12, 1983, abandoned.

[30] Foreign Application Priority Data

Jan. 13, 1982 [FR] France ..... 8200763

[51] Int. Cl.[4] ..... B22D 11/00; B22D 27/02; B22D 13/02

[52] U.S. Cl. ..... 164/465; 164/468; 164/504; 164/422

[58] Field of Search ..... 164/468, 465, 504, 421, 164/422, 464

[56] References Cited

U.S. PATENT DOCUMENTS

| | | | |
|---|---|---|---|
| 3,416,591 | 12/1968 | Babel | 164/465 |
| 3,713,478 | 1/1973 | Vogt | 164/465 |
| 3,844,332 | 10/1974 | Bucci | 164/465 X |
| 4,042,007 | 8/1977 | Zavarus et al. | 164/468 |
| 4,236,571 | 12/1980 | Pierrel | 164/465 |

FOREIGN PATENT DOCUMENTS

| | | | |
|---|---|---|---|
| 55-106664 | 8/1980 | Japan | 164/468 |
| 56-136264 | 10/1981 | Japan | 164/468 |
| 2103131A | 2/1983 | United Kingdom | 164/504 |

*Primary Examiner*—Nicholas P. Godici
*Assistant Examiner*—G. Reid
*Attorney, Agent, or Firm*—Dennis J. Williamson

[57] ABSTRACT

The process and apparatus according to the invention concern continuous casting of hollow bodies of metals such as aluminum, copper, steels of all types, or other metals or alloys. The process comprises introducing the liquid metal into an annular space between an outer mold and an inner mandrel, the liquid metal being subjected in the vicinity of the mandrel to the action of a movable magnetic field which entrains it in an upward direction. The magnetic field is preferably generated by a magnetic rotor which is disposed in the mandrel. The process is used in particular for producing blanks intended for the production of non-welded pipes and tubes.

5 Claims, 4 Drawing Figures

PROCESS AND APPARATUS FOR THE PRODUCTION OF HOLLOW BODIES BY CONTINUOUSLY CASTING IN A MAGNETIC FIELD

This application is a continuation of application Ser. No. 457,426, filed Jan. 12, 1983, now abandoned.

BACKGROUND OF THE INVENTION

The present invention relates to a process for the production of hollow bodies by continuous casting by using a central magnetic field, and the apparatus for carrying out the process.

The process according to the invention may be applied to all metals capable of being continuously cast by means of conventional methods of casting solid bodies, among which mention may be made of aluminum, copper and steels.

Although the process according to the invention may be quite generally applied to the production of hollow bodies having cross-sections of widely varying shapes, the process according to the invention will be applied with a particularly high degree of benefit to the production of hollow bodies of circular cross-section and in particular by operating using rotary continuous casting, in which case the hollow bodies produced may be used for example as blanks with inner and outer skins or surface layers of high quality, for the production of weld-free tubes.

The production of hollow bodies of circular cross-section, that is to say, hollow bodies having a hollow interior which is generally concentric to the outside section, has been the subject of many varied technical disclosures.

Generally, such known processes use a metal cylindrical or cylindrical-conical mandrel, comprising for example copper, which is internally cooled with water and which is disposed coaxially in the interior of the ingot mold or external casting mold. Arrangements are also made to cool the inner wall of the hollow body produced, generally by means of water, after the formation of a solidified surface layer. As the casting operation proceeds, the initially liquid metal solidifies in contact with the mandrel, the leading edge of solidification then progressing radially with respect to the mandrel.

As the solidification process begins from the free surface of the metal bath, it results in all the dross or scum material formed by slags, inclusions or other non-metal particles which are present on the surface of the bath being trapped in the solidified surface layer which forms the inner skin of the hollow body produced, and generally results in an inner skin which suffers from defects, typical incrustations, slags and folds or ripples, which will have to be removed by means of difficult and expensive surface treatments, before the hollow body produced is subsequently put to use.

The inner skin of such products therefore suffers from the same types of defect as are found on the outer skin of solid bodies in conventional casting processes. Such defects are further aggravated by the small amount of space available, which prevents any mechanical apparatus for at least partially removing them, from being introduced.

Certain processes have been developed, in an effort to overcome such difficulties, such as that described in Swiss Pat. No. 618,363 dated Jan. 6, 1977, which uses the electromagnetic effect of an outer single-turn inductor and an inner single-turn inductor to effect continuous casting of hollow bodies, without using an external mold or mandrel.

The inductors used in that process are supplied with a single-phase alternating current and therefore generate a stationary sinusoidal magnetic field which is generally referred to as a pulsating field.

The pulsating field basically promotes the generation of pressure forces within the liquid metal, which move the liquid metal away from the fixed walls in which the inductors are contained, without giving rise to substantial circulatory movements within the mass of liquid metal.

Thus, using that process, a ring of liquid metal is maintained in a condition of equilibrium by a magnetic field, the free surface of the metal being of a convex shape, as shown in FIG. 1 of the above-mentioned patent. Bearing in mind the small radius of action of the magnetic field, that necessarily means that the column of liquid metal is of small height. Such a method can probably be used for aluminium which has a relatively shallow solidification well and a relatively flat solidification leading edge.

By contrast, in the case of steel, being a metal of high density (at least with respect to aluminium) and being a much worse conductor of heat than aluminium, the solidification well, being the distance measured in the bar in the course of solidification from the free surface of the metal bath to the terminal solidification region, is very deep and much greater than that of aluminium. That would result in the necessity for extremely slow casting speeds in order to produce a solidified skin of sufficient strength to contain the metal which is still in a liquid condition, taking account of the pressure forces generated by the pulsating magnetic field, so that that process, assuming that it can be carried into effect, when used with steel, is totally unusable from the economic point of view.

Another way of improving the quality of the inner skin in cast hollow bodies, as described in French patent No. 2 180 494, comprises using a rotary continuous casting process in which a central mandrel is employed, a slag being continuously introduced between the annular surface of the metal in the course of solidification thereof, and the outside surface of the mandrel.

That process suffers from the disadvantage of interfering with heat exchanges and delaying the progression of the solidification leading edge, from the mandrel. In addition, it is necessary to carry out a treatment on the inner surface of the resulting product, before it is used, in order to remove inter alia the layer of slag which is deposited on the inner skin.

Moreover, the general difficulty of the problem to be solved will be noted, bearing in mind the hostile environment: the small amount of space available, both in respect of height and in respect of diameter, at the location of the mold, the danger of an explosion due to the use of water in the event of contact with the liquid metal, particularly when dealing with steel.

Research has therefore been carried out in an effort to find a process for the production of hollow bodies by continuous casting, which does not suffer from the above-indicated disadvantages and which in particular makes it possible to produce hollow bodies, the inner skin of which is of satisfactory quality.

In particular, research has been carried out into the possibility of producing an inner skin of a quality such as to permit hollow bodies to be used without particular surface preparation or with such surface preparation being reduced to a minimum.

The attempt has also been made to find an apparatus for carrying out such a process, which is simple and economical and which can be used for casting many metals or alloys.

SUMMARY OF THE INVENTION

The present invention concerns a process for the production of metal hollow bodies by vertical continuous casting, wherein a liquid metal is continuously introduced into an annular space between an outer metal mold which is cooled by circulation of a fluid, and an inner mandrel which is also cooled by the circulation of a fluid, the metal progressively solidifying in contact with the walls of the mold and the mandrel, with the formation of a hollow body which is extracted below the mold, and in which, in an annular region adjacent to the outer surface of the mandrel, the liquid metal is subjected to the reaction of a moving magnetic field which, within said metal, generates forces which have an upwardly directed vertical component and which entrain said metal towards the free surface of the metal bath.

Thus, in accordance with the process of the invention, the liquid metal which is in the vicinity of the inner mandrel is subjected to a sliding and rotating field. The vertical component of that field subjects the liquid metal in that region to ordered forces which entrain it upwardly in a direction opposite to the direction of extraction of the hollow body formed. In that annular region, that therefore produces an acceleration in the rising movement towards the free surface of the metal bath, of the inclusions or dross or scum material which are present in that region.

The circulatory movement of the liquid metal which occurs in the vicinity of the mandrel, in an upward direction, is then diverted into a radial direction as it approaches the free surface of the metal bath. That therefore results in the inclusions in the liquid metal being entrained, along the mandrel. At the surface of the metal bath, in the region close to the mandrel, the radial movement of the liquid metal moves the inclusions or floating particles of slag away. In that way, there is no longer the danger of such various particles or inclusions being trapped in the inner skin region of the hollow body produced.

In addition, the upward movement of the liquid metal, in the immediate vicinity of the outer surface of the inner mandrel, causes a raised or relief annular region to be formed at the surface of the metal bath. Therefore, the barrier effect of the raised annular region is added to the effect of radial displacement of the liquid metal towards the periphery, the barrier effect of the raised annular region therefore preventing the floating particles of slag or inclusions from reaching the proximity of the surface of the mandrel in the region in which the inner skin of the hollow body produced is formed.

The result of that is that the skin is of substantially higher quality than the skin which is produced without using a magnetic field giving the above-indicated effects.

The liquid metal is generally introduced in a continuous, controlled manner by means of a jet issuing for example from a casting nozzle which permits the flow rate and the impact of the jet to be controlled, both in regard to angle and position.

The free surface of the metal bath may either be in contact with the atmosphere or protected by any known means such as for example a neutral shielding gas which is introduced in a liquid or gaseous state, or a slag.

The mobile magnetic field which performs an essential function may be generated by any suitable means comprising inductor systems which are fixed or movable relative to the liquid metal and which are supplied with poly-phase alternating currents, or movable inductor systems formed by coils supplied with direct current, or permanent magnets.

A particularly simple and effective way of producing the movable magnetic field comprises using permanent magnets which are suitable disposed on a rotationally symmetrical rotor, contained in the inner mandrel, which is actuated with a rotary movement about its axis. In a preferred embodiment, said rotor, which carries the permanent magnets, is driven in rotation by the fluid for cooling the inner mandrel by means of a turbine or any other suitable direct or indirect drive means.

Generally, the process is so arranged as to favor the vertical component of the movable magnetic field, relative to the horizontal component, which tends to entrain the liquid metal in rotation about the mandrel.

As such a rotational movement of the liquid metal in the mold does not assist operation of the process, the attempt is made to reduce or block such movement by any suitable means. For that purpose, care is taken to ensure that the jet of liquid metal which passes into the mold is so oriented that the direction of displacement of that metal has a tangential component in that direction which is opposite to the direction of rotation due to a magnetic field.

The speed of rotation adopted in respect to the rotor is such that the sliding field produced is of a sufficient frequency to produce a substantial rising movement of the metal along the mandrel, without however that frequency being excessive, in which case the field is absorbed for the major part by the metal screen which forms the mandrel.

Speeds of rotation of from 1000 to 3000 rpm, corresponding to frequencies of from 17 to 50 Hz, are generally employed.

It may be advantageous for the outer surface of the inner mandrel, which is in contact with the metal, to be continuously lubricated during the casting operation, using a vegetable oil for example, a colza oil, which is known for that purpose.

The inner mandrel will have the taper required to permit the products to be properly removed from the mold.

The process according to the invention, as just described above, is applied in its broadest form to any type of continuous casting and in particular rotary continuous casting.

The rotary continuous casting operation which is generally carried out for producing solid bodies of circular cross section generally comprises a vertical ingot mold which rotates with a uniform movement about its axis, the cast metal being extracted vertically below the mold by a continuous helicoidal rotational-translatory movement in a downward direction.

Such a process is described in many publications such as French Pat. Nos. 1 440 618 and 2 119 874, and also in 'Revue de Metallurgie' CIT, February 1981 (pages 119 to 136).

When the process according to the invention is applied to rotary continuous casting, the liquid metal is introduced into the annular space between an outer mold which is disposed with its axis vertical, which is of circular cross section, which is cooled and which rotates at a uniform angular speed about its axis, and an inner mandrel which is also vertical and which is so arranged that in most cases the axis thereof is disposed at the same location as the axis of the outer mold, the mandrel being cooled by internal circulation of fluid and rotating about itself about its axis, in the same direction as the outer mold, the hollow blank formed being extracted vertically by a helicoidal downward movement, by extraction means.

As stated above, the liquid metal is subjected to a movable magnetic field having its source within the mandrel, so as to generate forces such that they impart to the liquid metal a movement which has an upwardly directed vertical component parallel to the axis of the mandrel. Advantageously, the angular speed of the inner mandrel is substantially equal to that of the outer mold, and that movement is either controlled by a mechanical apparatus or is the result of the hollow product being entrained by friction in the course of solidification on the mandrel.

Advantageously, the hollow product which is in the course of solidifying is subjected to the movable magnetic field, along the inner mandrel and in the proximity thereof, not only in the vicinity of the surface but over a height corresponding substantially to the whole of the height of the outer mold.

In a preferred continuous rotary casting process, the directions of rotation used are such that the rotary movement of the liquid metal due to the horizontal component of the movable magnetic field and the rotary movement of the outer mold and the mandrel are in opposite directions. The effect of upward movement of the metal along the mandrel is then most greatly marked, in spite of the general concave shape of the meniscus due to the rotary movement of the outer mold and the mandrel.

The speed of rotation of the outer mold is generally between 30 and 120 rpm.

The advantageous modes of performing the process according to the invention in the broad case can obviously be applied in the case of continuous rotary casting, and constitute the preferred embodiments of the process. It will be noted in that process that, because of the presence of the fluid-tight inner mandrel, there is no direct contact between the inner surface of the hollow product being formed, and the water, the cooling action being produced by way of the interposed mandrel. In order to produce the cooling effect, an anti-radiation screen may be provided, in alignment with the inner mandrel, with or without the addition of a gaseous cooling additive permitting the heat to be more easily carried away.

The invention also concerns an apparatus for carrying out the above-described process. The apparatus comprises a vertical outer mold having a metal inner wall surface which is cooled by internal fluid circulation, an inner mandrel having a metal wall surface which is cooled by inner fluid circulation, means for introducing a liquid metal at the upper part of the annular space between the mandrel and the mold, means for the downward extraction of the hollow body in the course of solidification, and means for generating a movable magnetic field, said means being disposed within the mandrel.

In this apparatus, the movable magnetic field may be generated by inductor windings which are supplied with poly-phase current and which are fixed with respect to the outer wall surface of the mandrel.

Preferably, the movable magnetic field is generated by means of an inductor system which rotates with respect to the outer wall surface of the mandrel and which comprises either windings supplied with direct current, or permanent magnets.

In the case of rotary casting, the apparatus being the subject of this invention also comprises means for driving the outer mold in rotation, and extraction means for extracting the hollow body in the course of solidification in a vertically downward direction, with a helicoidal movement. The inner mandrel is preferably disposed coaxially with respect to the mold.

In a preferred embodiment, rotary movement of the rotor is produced by the fluid of the cooling circuit, by means of a turbine disposed within the inner mandrel.

The inner mandrel is necessarily made of a non-magnetic material which advantageously has a high degree of thermal conductivity and minimum electrical conductivity. The inner portion of the mandrel, that is to say, the portion corresponding to the magnetic rotor, advantageously extends over a height which is substantially equal to the height of the outer mold, the rotor projecting above the free level of the metal bath.

A preferred way of generating the movable magnetic field comprises mounting the permanent magnets which are formed by parallelepipeds, with rectangular faces, at the periphery of a rotor formed by a magnetic metallic core or hub, along a helical line, with uniform North-South magnetisation, preferably in a radial direction.

In order to increase the magnitude of the magnetic field, the permanent magnets are arranged along two mutually displaced helical lines which extend around the rotor in the manner of a double-flight screw, in which case each helical line has uniform radial magnetisation, one of the helical lines comprising an array of magnets of which the North poles are closer to the axis of the rotor, and the other comprising magnets of which the South poles are closer to the axis of the rotor.

In order to increase the magnitude of the magnetic field, it is possible to provide more than two displaced helical arrays. In that case, the arrangement comprises an even number of helical lines, each of which has uniform radial magnetisation, the direction of magnetisation alternating from one helical array to the next. That arrangement, by means of permanent magnets, produces a movable poly-phase magnetic field which is infinitely easier to produce than by using a plurality of multi-turn inductors which are displaced in space and which would have to be supplied with poly-phase currents.

The above-indicated general design of the apparatus according to the invention achieves a high degree of simplicity, both from the construction point of view and from the point of view of use, and is highly compact.

That makes it possible to ensure a high degree of reliability and security in operation, while achieving a very favourable level of operating cost.

The following drawings and example describe, without limitation, an embodiment of the apparatus according to the invention, for producing hollow bodies of circular cross section by continuous rotary casting.

DESCRIPTION OF THE PREFERRED EMBODIMENT

Figure 1:
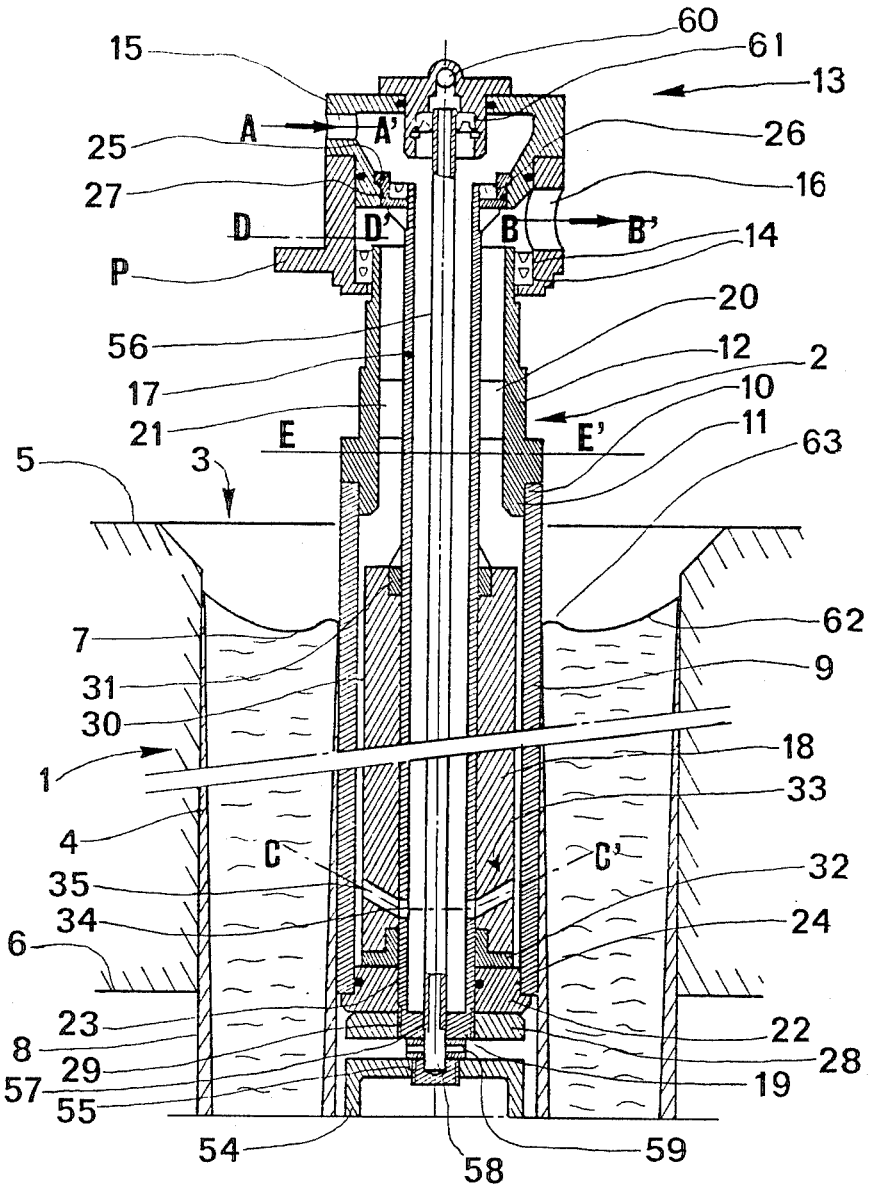
FIG. 1 shows an overall view in vertical axial section of the apparatus according to the invention.

The apparatus according to the invention, which is described herein in relation to a continuous rotary casting operation for producing hollow steel bars, is shown generally in FIG. 1 which is sectioned in the lower part thereof, in order to facilitate illustration of the arrangement.

The apparatus for continuous rotary casting of solid bodies of steel, of circular section, is known per se, in particular from the publications, the references of which are set out above.

The following description will therefore essentially relate to the novel means used for carrying out the process, and for the apparatus according to the invention.

FIG. 1 shows an apparatus for the continuous rotary casting of hollow bodies, in accordance with the invention, comprising a cooled outer mold or ingot mold 1, which rotates about a vertical axis, being of generally tubular shape and circular cross-section, an inner mandrel 2, a liquid metal feed system as diagrammatically indicated by the arrow 3, and a system for vertical helicoidal extraction movement of the cast products. As the latter two systems are the same as those used for the continuous rotary casting of solid round bars, they are known to the man skilled in the art and are therefore not illustrated. The outer mold or ingot mold 1 is represented simply by the wall 4 thereof, as limited at 5 and 6. The wall 4 generally has a slightly tapered configuration, with a reduction in section in the lower part, which serves for contact with the metal in the course of solidification. The cooling system and the rotary drive means thereof, being known to the man skilled in the art, are not illustrated. The free surface of the metal is indicated at 7 and the partially solidified hollow body, of circular section, is indicated at 8.

The hollow inner mandrel 2 comprises two portions: the lower portion which is disposed at the level of the mold 1 is immersed in the metal in the course of solidifying, constituting the active portion of the mandrel, and the upper portion, being disposed above the mold 1, carries the mechanisms for controlling and supporting the lower portion.

In its lower portion, the mandrel comprises a sleeve 9 of generally tubular shape and circular cross-section, the height thereof generally being slightly greater than the height of the mold 1.

The sleeve 9 is advantageously of a tapered configuration, with its section reducing in a downward direction to permit contraction of the metal as it solidifies. The sleeve 9 is generally made of non-magnetic material which is a good conductor of heat, for example copper or copper alloy.

Figure 3:
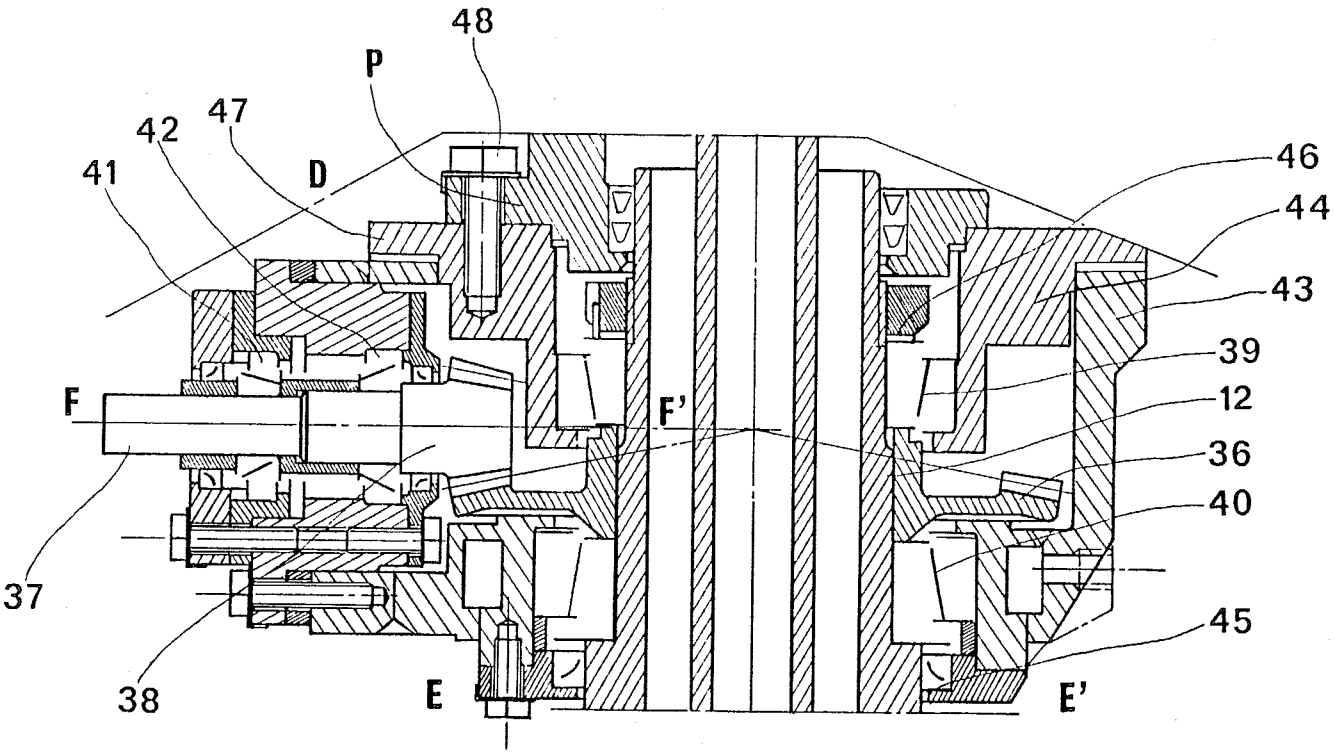
FIG. 3 shows a system for motorised rotary movement of the mandrel shown in FIG. 1, the system being positioned in FIG. 1 between the horizontal planes D-D' and E-E', although it is not shown in FIG. 1.

The mandrel 2 is held in position in the mold by support means which are shown in FIG. 3, in such a way that the sleeve 9 is perfectly coaxial with the mould 1.

The sleeve 9 is joined to a rotationally symmetrical support tube 12, for example by a sleeve connection as indicated at 10, with a static seal at 11. The support tube 12 forms the upper portion of the mandrel, and the upper end thereof engages into the mandrel head 13. A double lip seal 14 permits free rotary movement of the mandrel relative to the head 13, while ensuring that the arrangement is fluid-tight with respect to the fluid which circulates under pressure within the mandrel.

Rotary movement of the mandrel 9 is produced by a drive system as shown in FIG. 3, which ensures both that the mandrel 2 is motor-driven in rotation and that it is generally held in a vertical position, centered with respect to the mold 1, the axis of the mandrel being coincident with the axis of the mold 1. The mechanical drive arrangement is described hereinafter.

The head 13 which is fixed on the drive arrangement shown in FIG. 3 by a fixing lug P carries cooling fluid feed and discharge conduits 15 and 16 respectively.

Within the hollow mandrel 2, a central tube 17 which is of circular section and which is coaxial with the sleeve 9 supports, in the lower portion thereof, a magnetic rotor 18 which extends around the central tube 17 and which is mounted for free rotary movement relative to the central tube 17.

The tube 17 is fluid-tightly closed off in its lower portion 19; it is secured firmly to the support tube 12 by means of radial plates 20–21 which do not impede the axial flow of cooling fluid between 12 and 17.

The sleeve 9 and the tube 17 are fluid-tightly fixed to the lower portion by the annular bottom member 22, with static toric seals 23 and 24. At its upper end, the tube 17 is centered by an annular member 25, relatively to which it is free to rotate, by means of a lip-type seal 26. The member 25 is itself mounted within the head of the mandrel 13, fluid-tightly by means of a static toric seal 27.

A nut 28 which is screwed on to the tube 17 at 29 locks the bottom member 22 in place.

Thus, the sleeve 9, the support 12, the tube 17 and the bottom member 22 are rigidly fixed together and can rotate at the same rotary speed.

The magnetic rotor 18 is formed by a hollow cylinder which is freely rotatable on the tube 17, and carries magnetic masses on its outer surface. The particular structure of the magnetic rotor will be described hereinafter. The length of the rotor is such that the upper portion thereof clearly projects beyond the level corresponding to the free surface of the liquid metal in the vicinity of the sleeve 9. The construction is so arranged that the space between the rotor 18 and the sleeve 9 is as small as possible, bearing in mind the need to retain a sufficient flow section for the cooling fluid.

The speed of the rotor 18 is not linked to the speed of the tube 17 and the rotor rotates on rings of suitable material, for example a material based on a resin plus fibre of celeron type, as indicated at 31 and 32, which are positioned on the tube 17. The rotor 18, the speed of rotation of which must be high (from 1000 to 3000 rpm), is driven in rotation by the cooling fluid by means of a turbine 33 which is machined in the lower portion of the rotor and which is therefore integral therewith.

Figure 2:
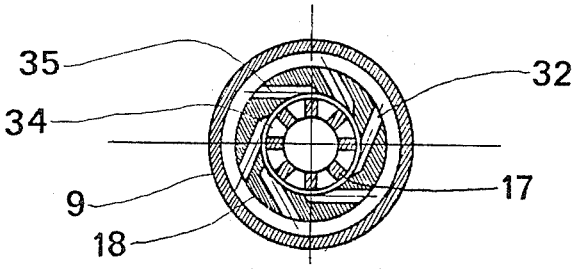
FIG. 2 shows the turbine for driving the magnetic rotor, in cross-section taken along line C-C' in FIG. 1.

FIG. 2 shows a cross-sectional view of the profile of the turbine. The cooling fluid which is under a suitable pressure within the tube 17 issues therefrom by way of radical holes as indicated at 34, a suitable number of which is distributed around the periphery of the tube 17. An array of apertures as indicated at 35, of suitable configuration, are distributed around the periphery of the rotor 18 and are so oriented as to cause the rotor to be driven in rotation by reaction.

The configuration of the apertures 35 and adjustment in respect of the pressure of the cooling fluid used permit the speed of rotation of the magnetic rotor 18 to be controlled so as to lie in the desired speed range. Thus, in accordance with this apparatus, the cooling fluid, which is generally water and which enters at 15 and which flows downwardly within the tube 17 and flows upwardly in the space 30 to issue at 16, provides both for cooling the sleeve 9, to permit removal of the heat of the metal bath, and cooling of the rotor and the magnetic masses.

With a water pressure of from 2 to 3 kg/cm$^2$, a suitable design of the components permits speeds of 3000 rpm and a temperature of less than 100° C. for the magnetic masses, with the speeds of circulation employed make it possible to avoid air being present in the cooling circuit.

The speed of rotation selected for the rotor will be preferentially the speed that produces a sufficient speed of the upward movement of the liquid metal.

The ratio between the speed of the upward movement of the liquid metal, and the speed of rotation of the rotor is dependent upon that speed of rotation. Beyond a critical speed of rotation, the speed of the upward motion of the liquid metal doesn't increase any more, but instead begins to decrease rapidly. That critical speed of rotation depends especially on the kind of material constituting the sleeve (9) and also on the thickness of that sleeve.

When the sleeve comprises copper, the critical speed of rotation of the rotor "$N_c$" is determined approximately by the formula:

$$N_c\,(\text{rpm}) = \frac{300{,}000}{e^2}$$

"e" being the thickness of the sleeve (9) in mm.

The rotary movement of the mandrel 2, which is synchronised with the rotary movement of the mold 1, is produced by the mechanism shown in FIG. 3. That assembly is positioned between the planes D-D′ and E-E′ in FIG. 1. The mechanism essentially comprises a toothed ring 36 which is a shrink fit on the member 12 which is moved by a drive shaft 37, at the end of which is a bevel gear 38.

The ring 36 is supported in its rotary movement by two taper roller bearing boxes or cases 39 and 40 which permit the mandrel 2 to be held in a fixed, centered, vertical position. The shaft 37 is also rotatable in a box or case having two taper roller bearings 41 and 42, with a fluid-tight, cooled casing 43–44 enclosing the entire arrangement. Seals 45 and 46 are provided for sealing the assembly, upon rotary movement of the mandrel.

The mandrel head 13 is fixed to the drive shaft carrier housing by the lugs P and 47 and the bolts 48.

The mandrel 2 is positioned on the mold 1 by a system (not shown) of lugs which are secured on the one hand to the operating floor structure which may be disposed at the height of the mold 1 and, on the other hand, to the casing 43–44 or to the head 13 of the mandrel. This therefore ensures that the mandrel is held in a properly defined, vertical position.

Figure 4:
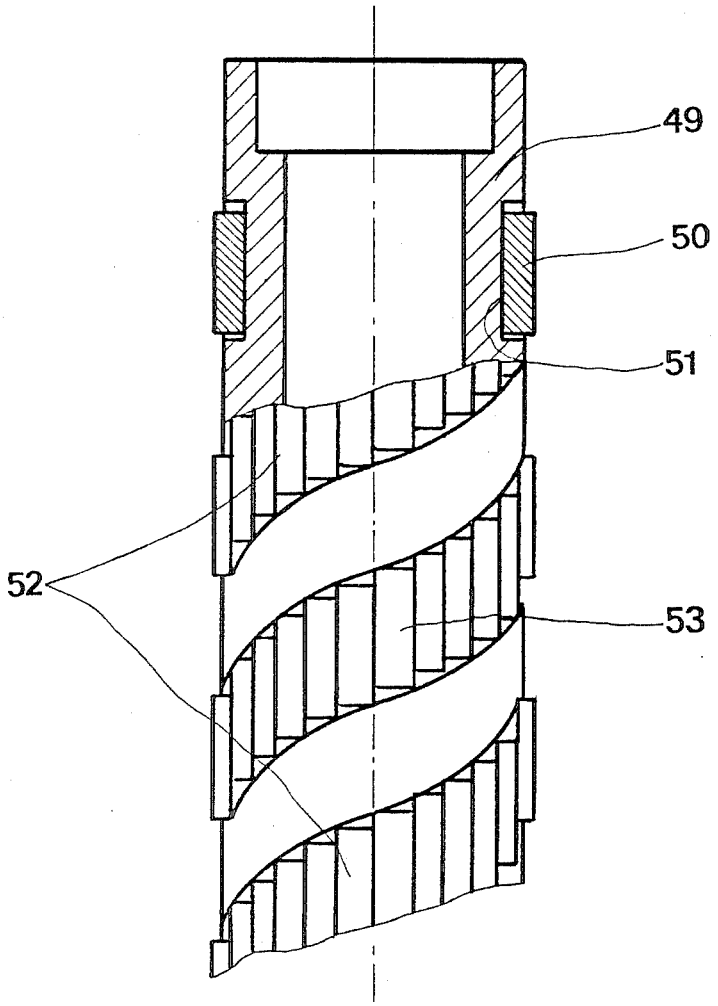
FIG. 4 shows a front view in partial section of the magnetic rotor shown in FIG. 1.

The structure of the magnetic rotor 18 for generating the movable field is shown in elevation in FIG. 4, with the upper part of the drawing being in cross-section.

The rotor comprises a hollow cylinder 49 of construction steel, the ends of which are shaped to receive celeron rings 31 and 32 for centering said rotor for rotary movement, with a minimum amount of friction.

The magnetic masses are formed by permanent magnets as indicated at 50, disposed in recesses or housings as indicated at 51 which are formed side-by-side in a helical configuration at the surface of the cylinder. The magnets are fixed in their respective recesses, for example by adhesive. Magnets of parallelepipedic shape, with rectangular faces, will advantageously be employed, with the long sides of the rectangular faces of the parallelepipedic shapes being parallel to the generatrices, with the North-South axis, which is perpendicular to the large faces, corresponding to the smallest distance between faces of the parallelepipedic shape and being radical, that is to say, perpendicular to the axis of the rotor.

In the construction shown in FIG. 4, there are two helical arrays, as indicated at 52 and 53, being coaxial and being disposed around the rotor in the manner of a double-flight right-handed screwthread, with each helical array being magnetically oriented in a uniform manner, that is to say, the poles which are closer to the axis of the rotor of the array of magnets of the same helical configuration are of the same type. In contrast, the magnetic orientation of the two helical arrays is opposite. Thus, in the construction shown in FIG. 4, the poles of the helical array 52 which are closer to the axis of the rotor are South poles while the poles of the helical array 53 which are closer to the axis of the rotor are North poles.

Any sufficiently stable permanent magnet may be used.

The direction in which the helical array or arrays is or are wound around the rotor must be the same as the direction of rotation of the rotor about its axis, as viewed from above. Thus, if the rotor, as viewed from above, rotates in the clockwise direction, the helical array or arrays must be of a right-handed pitch. By virtue of its rotary movement, that rotor structure generates a sliding field, the direction of displacement of which is at each point perpendicular to the flights of the helical arrangement and contained in the plane which is tangential to the surface of the cylinder. Therefore, the direction of displacement of the magnetic field has on the one hand a vertical component which entrains the liquid metal in an upward direction, and a horizontal component of the magnetic field, which tends to entrain the liquid metal in a rotary movement.

The pitch of the helical array or arrays, that is to say, the distance between two turns of the same helix along a generatrix, will be such that the horizontal component of the magnetic field remains low, but without bringing the magnetic masses on the same generatrix of the rotor too close together, so as to have field lines which penetrate in depth into the liquid metal. The distance on the same generatrix between the closest ends of a North magnet and a South magnet will preferably not be less than the long length of the basic parallelepipedic configuration.

The apparatus may be developed by envisaging the positioning of a screen or shielding member 54 below the rotary mandrel, as shown in FIG. 1, the function of the screen or shielding member being to reduce radiation from the internal surface of the hollow bar, once it has issued from the mandrel. Such a screen 54, which is formed by a hollow metal cylinder with a solid end portion, may be fixed by screwing at 55 to an extension portion on the central tube 17.

Whether or not a screen 54 is provided, it is also advantageously possible to provide a secondary cooling arrangement using a neutral shielding gas. Such a shielding gas is distributed, as shown in FIG. 1, by means of a tube 56 which is screw-threaded at 57 and screwed into an axial hole 58 in the end portion 19 of the tube 17. Radical ducts as shown at 59 form a communication between the hole 58 and the exterior. The gas which issues through those holes strikes against the inner surface of the hollow body, in the course of solidification thereof, and therefore accelerates the solidification process.

The shielding gas is supplied to the head 13 at 60. In that way, the cooling water cannot escape from the mandrel 2 and there is no danger of untimely penetration of water into the internal cavity in the bars, in the course of solidification thereof. At the upper end of the tube 56, a seal 61 prevents the cooling water in the tube 17 from passing.

It is also possible advantageously to provide a lubrication arrangement using a vegetable oil, of the colza oil type, in the interface between the sleeve 9 and the skin of metal in the course of solidification thereof, for example by means of a drip-feed distributor.

The above-described apparatus has the advantage of being particularly simple and compact and not requiring an electrical power source, either for generating the magnetic field or for driving the magnetic rotor in rotation. That design is particularly attractive in consideration of the environment at the location of the mould: high temperature, a very small amount of space available, and the danger of water infiltrating into contact with liquid metal.

Moreover, another advantage of the above-described apparatus is the simplicity of operation thereof. In fact, it is possible to fit to the same support tube 12, sleeves 9 of different dimensions, the working diameter of the sleeves, that is to say, the diameter of the portion thereof which is immersed in the liquid in the course of solidification, corresponding to the different inside diameters of the hollow bodies to be produced. For that purpose, instead of the sleeve 9 being in the form of a rotationally symmetrical cylinder of constant section, as shown in FIG. 1, the sleeve 9, over the entire portion thereof which is in contact with the cast metal, will be of a rotationally symmetrical shape corresponding to the internal section of the hollow bar to be produced and, it its upper region, a section corresponding to the sleeve connection 10 of the tube 12, the two portions of the sleeve 9 being connected in that case by a shoulder.

It will be appreciated that the diameter of the rotor 18 will be adapted to the inside diameter of the sleeve 9. The same rotor can be used for a number of different dimensions in respect of the sleeves 9 and therefore hollow bars.

The assembly is very easily dismantled by unscrewing the nut 28, removing the member 22 and removing the sleeve 9, the rotor 18 then coming out of its own accord while the tube 17 remains fixed with respect to the support tube 12.

The manner of performance of the process which is carried out by means of the above-described apparatus will now be described.

The liquid metal is continuously fed at 3 into the mold 1 which is rotated at a constant speed. The inner mandrel 2 is also rotated at a constant speed, substantially equal to the speed of the mold 1.

The rotary movement of the mandrel is produced either by the mechanism described with reference to FIG. 3, or simply by the friction of the metal in the course of solidifying against the inner mandrel, in which case the mechanism described with reference to FIG. 3 then serves only to hold the rotary mandrel in a vertical, centered position. The continuous rotary movement of the mold 1 and the mandrel 2 avoids any localised overheating of the mold and the mandrel, in particular due to radiation at the location at which the liquid metal is introduced into the mold at 3. Accordingly, the process has a high degree of symmetry, both thermal and geometric.

With the metal in contact with the cooled surface 4 of the mold 1 and the sleeve 9 which is also cooled, a solid crust 8 is formed, and solidification proceeds as the hollow bar is removed from the mold in a downward direction.

The free surface of the metal 7 which may possibly be protected by a flow of shielding gas which is supplied in a liquid or gaseous state, then assumes a general concave shape, as shown in FIG. 1, with the outer edges rising at 62. by virtue of rotation of the mold. Because of that, any inclusions, dross or scum materials or other non-metallic particles which float at the surface of the metal tend to move away from the periphery thereof. That results in an outside surface of particularly high quality, which does not require any surface preparation before a subsequent transformation operation. That is well known and disclosed inter alia in the above-mentioned article from 'Revue de Metallurgie-CIT'.

At the central mandrel, the vertical component of the movable magnetic field generated by the rotary rotor 18 has the effect of completely changing the normal conditions of solidification in the vicinity of the outer surface of the sleeve 9. In fact, the upward flow of liquid metal which occurs along that sleeve rapidly entrains any dross or scum material and inclusions which may be present, to the free surface of the metal and in addition that flow of liquid metal, which is then diverted radially towards the periphery, causes the level of liquid metal in the vicinity of the mandrel 9 to rise, as well as causing the formation of an annular raised or relief area 63, which, by virtue of its shape, prevents the dross or scum material on the free surface of the metal bath 7 from being deposited on the inner surface of the hollow body in the course of solidification. This mechanical barrier effect is added to the entrainment effect generated by the surface flow of liquid metal, which keeps the scum or dross materials which are to be found on the bath, away from the mandrel.

In order to achieve a raised or relief area of maximum amplitude at the location 63, the mode of operation is such that the rotary movement of the metal, due to the horizontal component of the movable magnetic field, is counteracted by the general movement in the opposite direction of the hollow bar in the course of solidification. Therefore, the direction of rotation of the hollow bar 8 and consequently the direction of rotation of the wall of the mold 1 which entrains it, and also the direction of rotation of the mandrel 2, must therefore be opposite to the direction of rotation of the rotor 18.

The liquid metal distribution jet is oriented in such a way that is preserves maximum efficiency of the rising and convection currents in the vicinity of the mandrel. For that purpose, the jet 3 is preferably so oriented that the movement of the metal which is poured into the mold has a radial centrifugal component, the tangential component which tends to cause the bath to rotate being directed in the direction of rotation of the mold 1. Moreover, the stirring effect which is carried out on the liquid metal in the course of solidification, in the vicinity of the mandrel, has the effect of refining the structure of the inner skin of the hollow body produced.

The result of that is a very good inner skin on the hollow body, which does not require any prolonged surface treatment for the purposes of continuing the production cycle.

The process for continuous rotary casting of hollow bodies is particularly suitable for dealing with steel. For example, it is possible to produce steel bars which are from 350 to 400 mm in outside diameter, and from 115 to 200 mm inside diameter.

To produce an outside diameter of 400 mm and an inside diameter of 200 mm, the operating parameters are as follows:

Height of the mold: 430 mm
Height of the magnetic rotor: 350 mm
Speed of rotation of the mold: 40 rpm
Speed of rotation of the mandrel: 40 rpm (in the same direction as the mold)
Speed of rotation of the rotor: 3000 rpm (in the opposite direction to the direction of rotation of the mold)
Copper mandrel, thickness: 10 mm
Cooling water pressure: 2.5 bars.

Although the example just given above concerns using the process according to the invention for continuous rotary casting, that is to say, a process in which the hollow body cast is driven in rotation, as well as the mold, the process according to the invention also applies in its broadest form to the processes in which the mold is fixed. In particular, it can be applied to processes wherein inductor means which are distributed in the vicinity of the wall of the mold, which is in contact with the metal in the course of solidification, generate movable magnetic fields which act on the liquid metal.

We claim:

1. A process for the production of hollow metal bodies by vertical continous casting comprising the steps of: (a) introducing liquid metal into an annular space defined by an outer metal mold which is cooled by circulation of a fluid, and an inner mandrel which is also cooled by the circulation of a fluid, the mold and mandrel rotating at substantially the same speed and in the same direction, the metal progressively solidifying upon contact with the walls of the mold and the mandrel to form a hollow body which can be extracted from the mold, (b) generating a sliding and rotating magnetic field within said mandrel and applying said magnetic field to the liquid in the annular region adjacent to the outer surface of the mandrel, to generate force within said liquid metal, in said annular region, having an upwardly directed vertical component to thereby entrain said liquid metal towards the free surface of the bath, wherein the common direction of rotation of the mold and the mandrel is opposite to the direction of rotation of the sliding and rotating magnetic field.

2. A process for the production of hollow metal bodies by vertical continuous casting comprising the steps of (a) introducing liquid metal into an annular space defined by an outer rotating metal mold which is cooled by circulation of a fluid, and an inner rotating mandrel which is also cooled by the circulation of a fluid, said inner mandrel being rotated in the same direction as the outer mold, the metal progressively solidifying upon contact with the walls of the mold and the mandrel to form a hollow body which can be extracted from the mold, (b) generating a sliding and rotating magnetic field by a rotatable inductor disposed within the inner mandrel, said rotating inductor rotating in a direction opposite to that of the mold and mandrel, and applying said magnetic field to the liquid metal in the annular region adjacent to the outer surface of the mandrel to generate forces within the metal in said annular region having an upwardly directed vertical component to thereby entrain said metal towards the free surface of the bath.

3. An apparatus for the production of hollow metal bodies by continuous casting comprising a vertically disposed rotatable outer mold having an inner metal wall which is cooled by internal fluid circulation, means for rotating the mold and mandrel, means for introducing a liquid metal at the upper portion of the annular space between the mandrel and the mold, and means for extracting the hollow body in the course of solidification, in a downward direction, and means for generating a sliding and rotating magnetic field contained within the mandrel, said means for generating comprises a hollow tube centrally located in the mandrel, a magnetic rotor mounted on said hollow tube for free rotary movement therewith, and a turbine means located such that the circulation of the internal fluid causes the magnetic rotor to rotate, said field generating forces in said angular region, said force having an upwardly directed component to entrain the metal to thereby carry impurities to the upper portion of the annular space.

4. An apparatus according to claim 3, wherein the turbine means comprises a first array of apertures situated around the periphery of the rotor, a second array of apertures located on said hollow tube and aligned with said first array of apertures wherby circulation of the fluid through said hollow tube and said first and second arrays of apertures propels said rotor.

5. A process for the production of hollow metal bodies by vertical continuous casting comprising the steps of: (a) introducing liquid metal into an annular space defined by an outer metal mold which is cooled by circulation of a fluid, and an inner mandrel which is also cooled by the circulation of a fluid, the metal progressively solidifying upon contact with the walls of the mold and the mandrel to form a hollow body which can be extracted from the mold, (b) generating a sliding and rotating magnetic field within said mandrel using a rotor mounted on a tube driven by a turbine propelled by the circulation fluid, and applying said magnetic field to the liquid metal in the annular region adjacent to the outer surface of the mandrel, to generate forces within said liquid metal in said annular region having an upwardly directed vertical component thereby to entrain said metal towards the free surface of the bath.

* * * * *